US011149947B2

(12) United States Patent
Baumgartner et al.

(10) Patent No.: US 11,149,947 B2
(45) Date of Patent: Oct. 19, 2021

(54) CAN COMBUSTION CHAMBER

(71) Applicant: ANSALDO ENERGIA SWITZERLAND AG, Baden (CH)

(72) Inventors: Felix Baumgartner, Waldshut-Tiengen (DE); Michael Thomas Maurer, Bad Säckingen (DE); Christof Graber, Endingen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 753 days.

(21) Appl. No.: 14/928,433

(22) Filed: Oct. 30, 2015

(65) Prior Publication Data

US 2016/0123593 A1 May 5, 2016

(30) Foreign Application Priority Data

Nov. 3, 2014 (EP) ..... 14191480

(51) Int. Cl.

| | |
|---|---|
| ***F23R 3/06*** | (2006.01) |
| ***F23R 3/46*** | (2006.01) |
| ***F23R 3/00*** | (2006.01) |
| ***F23C 6/02*** | (2006.01) |
| ***F01D 9/02*** | (2006.01) |

(52) U.S. Cl.

CPC ..... *F23R 3/06* (2013.01); *F01D 9/023* (2013.01); *F23C 6/02* (2013.01); *F23R 3/002* (2013.01); *F23R 3/46* (2013.01); *F23R 2900/00013* (2013.01); *F23R 2900/03042* (2013.01); *F23R 2900/03044* (2013.01)

(58) Field of Classification Search

CPC .... F23R 3/002; F23R 3/06; F23R 3/08; F23R 3/46; F23R 2900/03041; F23R 2900/03042; F23R 2900/03043; F23R 2900/03044; F02C 7/18; F01D 9/023; F23C 6/02; F23C 7/04

See application file for complete search history.

(56) References Cited

U.S. PATENT DOCUMENTS 3,657,883 A * 4/1972 De Corso ..... F23R 3/46 60/39.37
5,168,699 A * 12/1992 McCarty ..... F02C 7/266 60/39.091

(Continued)

FOREIGN PATENT DOCUMENTS

CN 1320312 C 6/2007
CN 103375262 A 10/2013

(Continued)

OTHER PUBLICATIONS

The Extended European Search Report dated Apr. 28, 2015, issued in corresponding European Patent Application No. 14191480.4-1605. (6 pages).

(Continued)

*Primary Examiner* — Todd E Manahan
*Assistant Examiner* — Marc J Amar
(74) *Attorney, Agent, or Firm* — Buchanan Ingersoll & Rooney PC

(57) ABSTRACT

The can combustion chamber includes a casing housing a plurality of cans. Each can includes a wall and a perforated cooling liner around the wall. Cooling liners of adjacent cans have staggered perforations.

3 Claims, 3 Drawing Sheets

(56) References Cited

U.S. PATENT DOCUMENTS

| | | | | |
|---|---|---|---|---|
| 5,758,504 | A * | 6/1998 | Abreu | F23R 3/002 60/754 |
| 6,182,451 | B1 * | 2/2001 | Hadder | F23R 3/007 60/732 |
| 6,494,044 | B1 | 12/2002 | Bland | |
| 6,840,048 | B2 | 1/2005 | Han et al. | |
| 6,964,170 | B2 * | 11/2005 | Alkabie | F23M 20/005 60/772 |
| 7,886,517 | B2 * | 2/2011 | Chopra | F01D 9/023 60/39.37 |
| 8,151,570 | B2 * | 4/2012 | Jennings | F01D 9/023 60/759 |
| 8,794,961 | B2 * | 8/2014 | Chandler | F23R 3/002 431/352 |
| 8,834,154 | B2 * | 9/2014 | Kishida | F23R 3/06 431/352 |
| 8,887,508 | B2 * | 11/2014 | Brown | F01D 9/023 60/754 |
| 9,080,447 | B2 | 7/2015 | McMahan et al. | |
| 9,133,722 | B2 * | 9/2015 | LeBegue | F23R 3/46 |
| 9,249,977 | B2 | 2/2016 | Kimura et al. | |
| 9,279,588 | B2 * | 3/2016 | Commaret | F23R 3/06 |
| 9,546,601 | B2 * | 1/2017 | Kim | F23C 5/08 |
| 9,709,279 | B2 * | 7/2017 | Crothers | F23R 3/42 |
| 9,879,605 | B2 * | 1/2018 | Maurer | F02C 7/18 |
| 10,139,109 | B2 * | 11/2018 | Thackway | F23R 3/06 |
| 2004/0060298 | A1 | 4/2004 | Han et al. | |
| 2004/0211188 | A1 | 10/2004 | Alkabie | |
| 2007/0209366 | A1 | 9/2007 | Gerendas et al. | |
| 2013/0160453 | A1 | 6/2013 | Kimura et al. | |
| 2013/0283804 | A1 * | 10/2013 | LeBegue | F01D 9/023 60/740 |
| 2013/0333212 | A1 * | 12/2013 | Janardhan | F23R 3/06 29/888.012 |
| 2014/0137535 | A1 * | 5/2014 | Kim | F02C 7/24 60/39.37 |
| 2014/0144147 | A1 | 5/2014 | Kishida | |
| 2014/0283520 | A1 | 9/2014 | McMahan et al. | |
| 2014/0290258 | A1 * | 10/2014 | Gerendas | F23R 3/002 60/754 |
| 2014/0345287 | A1 * | 11/2014 | Kulkarni | F23R 3/10 60/772 |
| 2015/0159873 | A1 * | 6/2015 | Melton | F01D 25/26 60/726 |
| 2015/0241066 | A1 * | 8/2015 | Crothers | F23R 3/04 60/772 |

FOREIGN PATENT DOCUMENTS

| | | | |
|---|---|---|---|
| CN | 104040260 | A | 9/2014 |
| CN | 104061594 | A | 9/2014 |
| CN | 104879783 | A | 9/2015 |
| EP | 1 832 812 | A2 | 9/2007 |
| EP | 2 660 519 | A1 | 11/2013 |

OTHER PUBLICATIONS

Office Action (Communication) dated Jul. 17, 2018, by the European Patent Office in corresponding European Patent Application No. 14 19 1480.4. (5 pages).

First Office Action dated Nov. 27, 2018, by the Chinese Patent Office in corresponding Chinese Patent Application No. 201510735088.6, and an English Translation of the Office Action. (21 pages).

* cited by examiner

Fig. 3
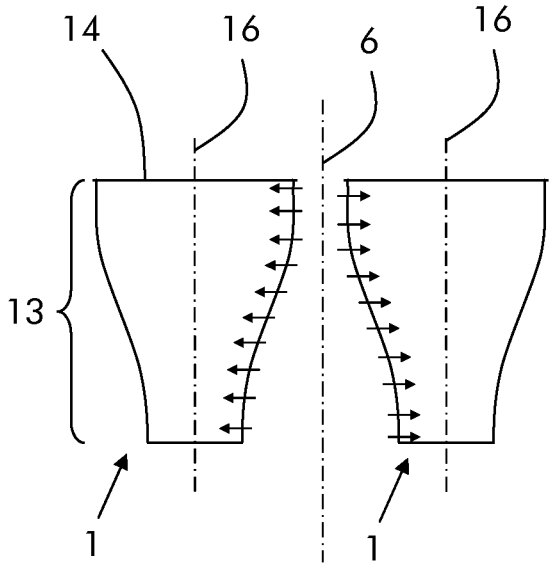
Fig. 4
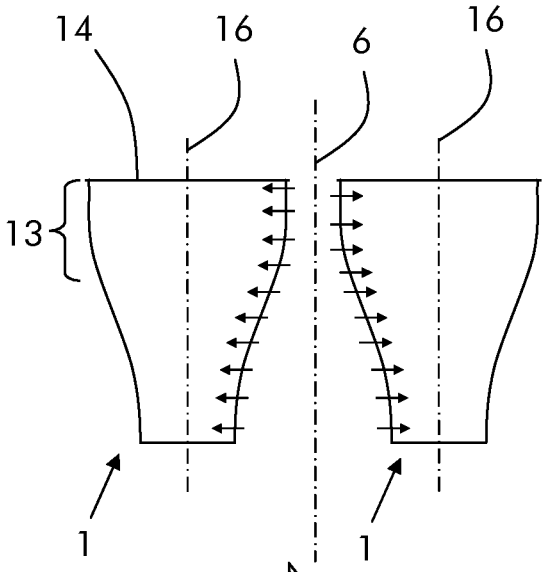
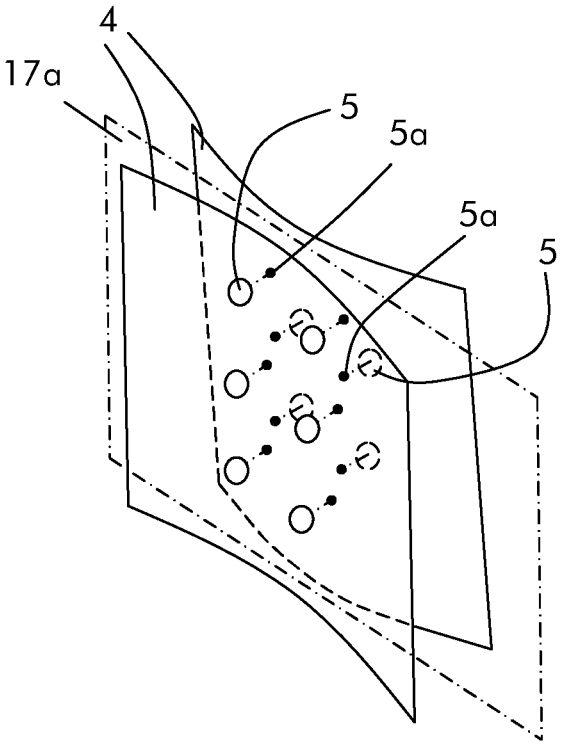
Fig. 5
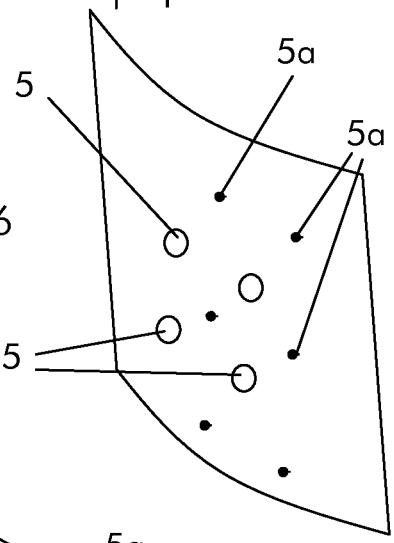
Fig. 6
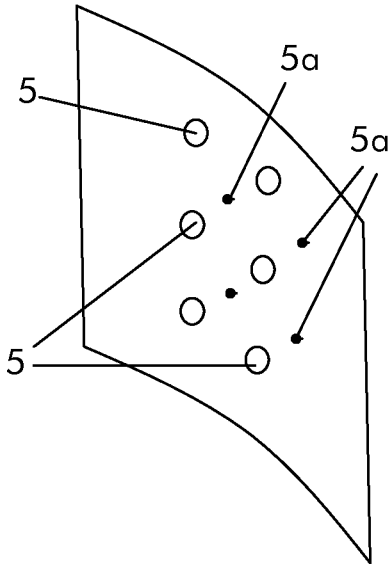
Fig. 7

CAN COMBUSTION CHAMBER

TECHNICAL FIELD

The present invention relates to a can combustion chamber. In particular the can combustion chamber is part of a gas turbine.

BACKGROUND

Gas turbines are known to comprise a compressor where air is compressed to be then forwarded to a combustion chamber. In the combustion chamber a fuel is supplied and is combusted with the compressed air from the compressor, generating hot gas that is forwarded to a turbine for expansion.

Over time a number of different configurations have been proposed for the combustion chamber, such as the can combustion chamber. A can combustion chamber has a casing that houses a plurality of cans; fuel and compressed air are supplied into each can and combustion occurs; the hot gas from all the cans is then forwarded to the turbine.

Each can has typically a structure with a wall and a perforated cooling liner enclosing the wall; during operation compressed air passes through the perforations of the liner and impinges the wall, cooling it.

Traditionally, for ease of design and manufacture, the liners of all the cans of a combustion chamber are equal and are symmetric over a plane passing through the longitudinal axis of the casing. In this configuration the liners of adjacent cans have facing perforations.

Facing perforations can cause significant pressure drop at the areas between the perforations and thus limited mass flow through the perforation and consequently reduced cooling of the can walls. In addition, since the pressure affects mass flow and vice versa, the pressure and mass flow can become unstable and can start to fluctuate, further increasing pressure drop and decreasing mass flow. All these effects are worse at parts of the cans facing to the turbine, because typically here the liners of adjacent cans are closer.

For example, FIG. 9 shows two parts of adjacent cans 1 (for example can parts facing the turbine) each having a wall 2 enclosing a combustion space 3 and a liner 4 with perforations 5; reference 6 indicates the casing axis. FIG. 9 shows that the perforations 5 face one another and reference 7 indicates the areas between the perforations.

SUMMARY

An aspect of the invention includes providing a can combustion chamber with improved cooling of the can walls.

These and further aspects are attained by providing a can combustion chamber in accordance with the accompanying claims.

BRIEF DESCRIPTION OF THE DRAWINGS

Further characteristics and advantages will be more apparent from the description of a preferred but non-exclusive embodiment of the can combustion chamber, illustrated by way of non-limiting example in the accompanying drawings, in which:

FIGS. 3 through 7 show different embodiments of the cans;

DETAILED DESCRIPTION OF EXEMPLARY EMBODIMENTS

Figure 1:
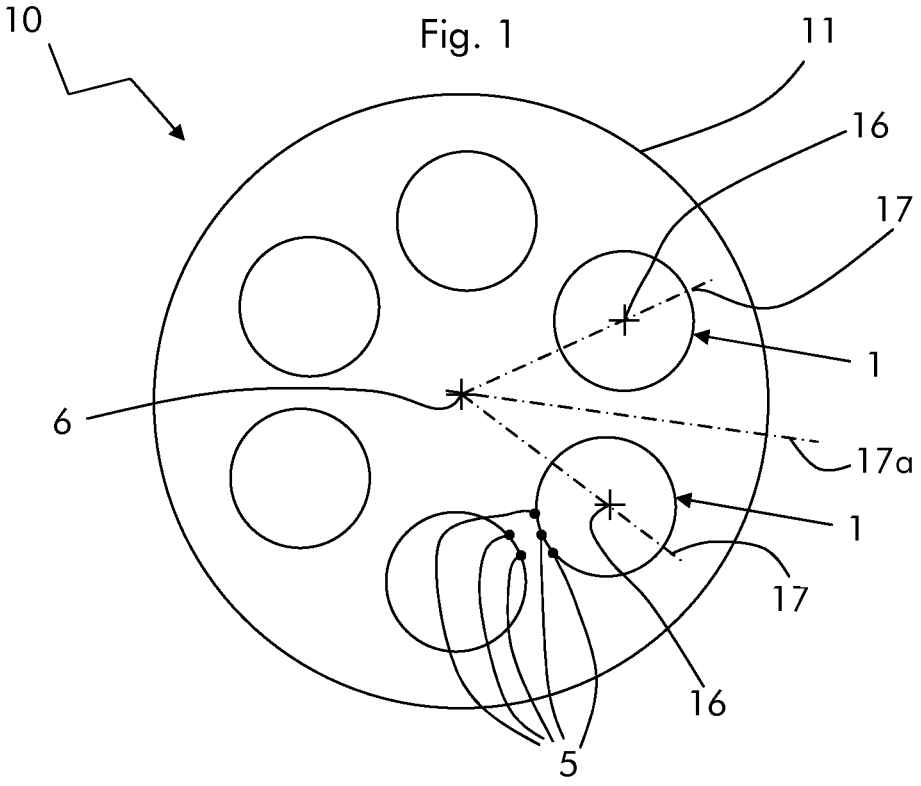
FIG. 1 shows a schematic front view of the can combustion chamber, in this figure only few perforations of the liners are shown.
Figure 2:
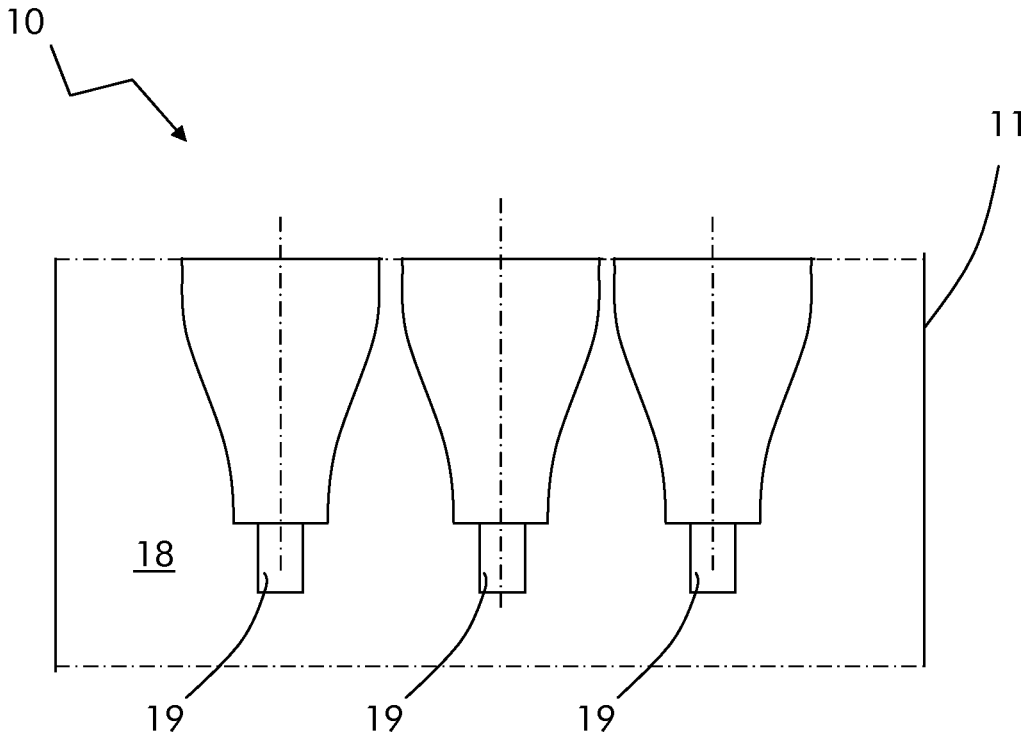
FIG. 2 shows an enlarged side view of the cans of the can combustion chamber of FIG. 1.

With reference to the figures, these show a can combustion chamber 10; the can combustion chamber 10 is preferably part of a gas turbine which also includes a compressor for compressing air and a turbine for expanding hot gas generating by combustion of a fuel with the compressed air in the can combustion chamber 10.

The can combustion chamber 10 has a casing 11 which houses a plurality of cans 1; naturally each number of cans is possible according to the needs, even if only six cans are shown in the figures.

Each can 1 comprises a wall 2 and a perforated cooling liner 4 around the wall 2. Cooling liners 4 of adjacent cans 1 have staggered perforations 5, i.e. the perforations are not aligned.

In different embodiments the perforations 5 can be staggered over a staggering length corresponding to the whole length 13 of the adjacent cans 1, as shown in FIG. 3, or only over a staggering length 13 shorter than the can length; in this last case the staggering length 13 is preferably located at the outlet 14 of the cans (i.e. at areas of the cans 1 facing the turbine, FIG. 4) because the liners of adjacent cans are closer there.

Each can 1 has a longitudinal axis 16 and a longitudinal plane 17 passing through the longitudinal axis 16; the perforations 5 are non-symmetric with respect to the longitudinal plane 17.

In addition the casing 11 has the longitudinal axis 6 and the longitudinal planes 17 of the cans 1 pass through the longitudinal axis 6 of the casing 11.

Figure 8:
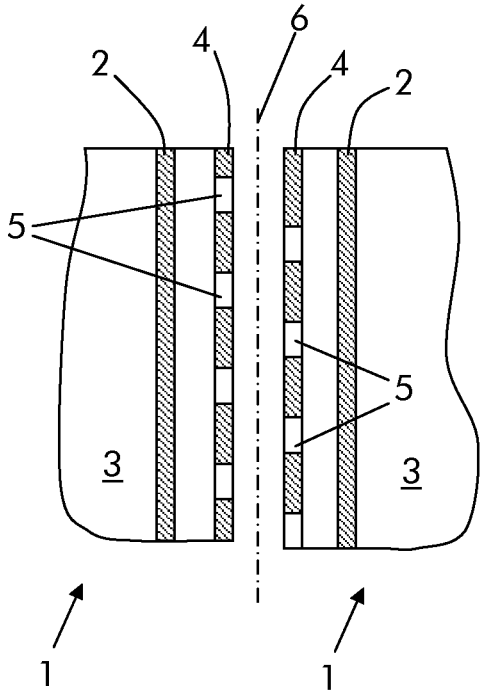
FIG. 8 shows an enlarged portion of FIG. 4.
Figure 9:
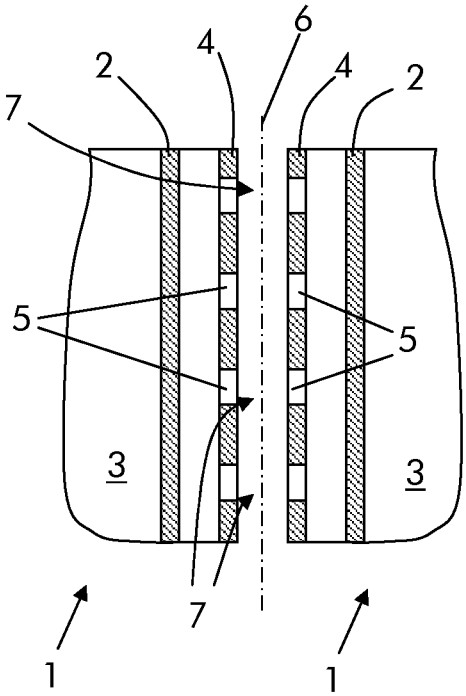
Fig. 9 Prior Art
FIG. 9 shows adjacent can portions according to the prior art.

The perforations can be axially or perimetrally (i.e. over the perimeter) staggered. FIG. 8 shows portions of two adjacent cans 1 with perforation axially staggered; FIG. 1 shows adjacent cans with perforation 5 (few perforations indicated only for two cans) perimetrally staggered; FIGS. 5-7 show portions of two adjacent cans perimetrally and axially staggered; in particular FIG. 5 shows two adjacent liners 4 while FIGS. 6 and 7 show each one of the liners 4 of FIG. 5; in addition, in these figures reference 5*a* identifies the projection of the perforation 5 of one liner on the other liner. In this example these projections are perpendicular to a plane 17*a* passing through the axis 6 and between the two adjacent cans 1.

Preferably the perforations 5 of the liners 4 of different cans 1 have equal pattern, i.e. the pattern over the whole liner 4 is the same but opposite parts of the liners (i.e. the parts facing other liners 4) are different from one another, for easy of designing and manufacturing.

The operation of the can combustion chamber is apparent from that described and illustrated and is substantially the following.

Compressed air from the compressor is supplied into the chamber 18 defined by the casing 11. Compressed air is mixed with fuel in the burners 19 (one or more burners are connected to each can) and the resulting mixture is supplied into the cans 1. Within the cans 1 combustion occurs with generation of hot gas that is forwarded to the turbine for expansion.

Within the chamber 18 compressed air passes though the perforations 5 of the liners 4 and cools the walls 2 (impingement cooling). Since the perforations 5 are staggered, there is no flow subdivisions in opposite directions in areas where the adjacent liners 4 are so close that the flow entering the perforations of one liner can influence the flow passing through the perforations of the other liner, such that pressure drop can be limited and compressed air mass flow is large (larger than with the liner configuration of the prior art) with benefit for the cooling of the walls 2.

Naturally the features described may be independently provided from one another.

In practice the materials used and the dimensions can be chosen at will according to requirements and to the state of the art.

REFERENCE NUMBERS

1 can
2 wall
3 combustion space
4 liner
5 perforation
5*a* projection of the perforations of one liner on another liner
6 casing axis
7 areas between the perforations
10 combustion chamber
11 casing
13 staggering length
14 outlet of the can
16 longitudinal axis of the can
17 longitudinal plane
17*a* plane
18 chamber
19 burner

The invention claimed is:

1. A can combustion chamber, comprising:

a casing housing a plurality of can combustors, each can combustor including:

a combustor wall; and a cooling liner around the combustor wall, the cooling liner having a wall including a plurality of perforations, the cooling liner wall facing a wall of a cooling liner of an adjacent can combustor of the plurality of can combustors, the plurality of perforations of the cooling liners of different can combustors of the plurality of can combustors have equal patterns and being axially and perimetrally staggered so that none of the plurality of perforations are aligned with any of a plurality of perforations of the wall of the cooling liner of the adjacent can combustor wherein each can combustor includes a longitudinal axis and a longitudinal plane passing through the longitudinal axis, wherein the plurality of perforations of each can combustor are non-symmetric with respect to the respective longitudinal plane and the casing has a longitudinal axis, wherein the longitudinal plane of each can combustor passes through the longitudinal axis of the casing and the perforations of each liner project on the liners of adjacent can combustors perpendicularly to a plane passing through the longitudinal axis of the casing and between the two adjacent can combustors.

2. The can combustion chamber of claim 1, wherein the plurality of perforations of the adjacent can combustors are staggered over a whole length of the adjacent can combustors.

3. The can combustion chamber of claim 1, wherein the plurality of perforations are arranged on each can combustor proximal an outlet of the can combustors.

* * * * *